US007104745B2

(12) United States Patent
Ochoa

(10) Patent No.: US 7,104,745 B2
(45) Date of Patent: Sep. 12, 2006

(54) ELONGATED FRONT END LOADER ATTACHMENT

(76) Inventor: Neil Ochoa, 505 24th St., Alamogordo, NM (US) 88310

( * ) Notice: Subject to any disclaimer, the term of this patent is extended or adjusted under 35 U.S.C. 154(b) by 96 days.

(21) Appl. No.: 10/341,856

(22) Filed: Jan. 14, 2003

(65) Prior Publication Data

US 2004/0136822 A1 Jul. 15, 2004

(51) Int. Cl.
*E02F 3/40* (2006.01)

(52) U.S. Cl. ..... 414/722; 37/444; 414/800

(58) Field of Classification Search ..... 414/723, 414/722, 800, 607; 37/444, 403; 147/222
See application file for complete search history.

(56) References Cited

U.S. PATENT DOCUMENTS

| | | | | |
|---|---|---|---|---|
| 684,911 | A | 10/1901 | Collins | |
| 1,868,562 | A | 7/1932 | Chubb et al. | |
| 2,440,765 | A | 5/1948 | Acton | |
| 2,675,139 | A * | 4/1954 | Mercier et al. | 414/607 |
| 3,498,489 | A | 3/1970 | Love | |
| 3,878,959 | A | 4/1975 | Holdeman et al. | |
| 3,914,884 | A | 10/1975 | Guinot | |
| 3,935,953 | A | 2/1976 | Stedman | |
| 3,938,680 | A * | 2/1976 | Grimes | 414/722 |
| 3,957,167 | A | 5/1976 | Jacobson et al. | |
| 4,903,418 | A | 2/1990 | Loudon | |
| 5,076,749 | A | 12/1991 | Petitto et al. | |
| 6,108,951 | A * | 8/2000 | Renfrow et al. | 37/468 |
| 6,264,004 | B1 * | 7/2001 | Miyamoto | 187/222 |
| 6,578,297 | B1 * | 6/2003 | Forsberg | 414/722 X |
| 6,588,127 | B1 * | 7/2003 | Brittian, III | 37/403 |

* cited by examiner

*Primary Examiner*—Donald Underwood
(74) *Attorney, Agent, or Firm*—Dennis F. Armijo

(57) ABSTRACT

A front end loader attachment with a deck of exaggerated length, low height, and narrow width which remains constant in proportion from the front to the back. The attachment has a backplate that has a tool engagement comprising a mechanical quick coupler that facilitates fast and convenient removal of the attachment that conforms to the articulating arms of the skid steer loader or other such front loading handling equipment. The attachment is designed to be used in inaccessible places due to limitations or safety reasons such as conveyor systems in mining operations.

9 Claims, 7 Drawing Sheets

ELONGATED FRONT END LOADER ATTACHMENT

BACKGROUND OF THE INVENTION

1. Field of the Invention (Technical Field)

The present invention relates to construction equipment and more particularly to front end loader attachments.

2. Background Art

The present invention is an elongated bucket type attachment that is used to remove material or debris from narrow, low or other hard to reach places. In addition, the present invention is designed to be used in inaccessible places because of space limitations or safety reasons. For instance, conveyor systems in mining operations are difficult to clean up from debris falling off the conveyor system. Typically, the system must be shut down to allow laborers to shovel the debris into piles, which are then removed by a loader.

A typical loader attachment is used for digging and carrying a load to a predetermined location or for moving a load form one location to another. The loader attachment is typically a scoop or bucket and can be of various sizes. A typical loader device of this type is described in U.S. Pat. No, 3,935,953. In addition, there are several other types of attachments for specialized uses.

Some of the prior art patents for the aforementioned specialized purposes are described below.

U.S. Pat. No. 4,903,418 describes a hydraulic loader attachment for removing and transporting trees, bushes or other plants. It consists of a digging attachment with a concave scoop.

U.S. Pat. No. 684,911 teaches a load and carry apparatus for removing coal or ore from low veins and dumping the material onto a truck or rail car. The device is self contained and is made up of several complex moving parts to dig into the material, move the entire bucket portion onto the center of the carriage where the carriage device is moved to a loading station and the bucket portion lifted to dump the material.

U.S. Pat. No. 3,914,884 describes a hydraulic shovel scoop. This device is specifically designed for digging purposes only.

U.S. Pat. No. 2,440,765 is a power loader device with increased leverage for lifting a load with the bucket device.

None of these prior art devices provide an apparatus or method of cleaning or removing debris from around conveyors or other moving machinery using an exaggerated length loading attachment, thus keeping workers at a safe distance from dangerous conditions.

SUMMARY OF THE INVENTION (DISCLOSURE OF THE INVENTION)

An elongated hydraulic loader attachment for removing material or debris from narrow, low or other hard to reach places or inaccessible places is disclosed. The preferred attachment for a hydraulically operated loader for shoveling debris comprises a coupling mechanism for affixing the attachment to the hydraulically operated loader and an elongated deck comprising a substantially flat surface and a squared front edge. The preferred elongated deck comprises a length approximately the same as a lift height of the hydraulically operated loader. The preferred elongated deck comprises a low height relative to a height of the hydraulically operated loader. The preferred elongated deck comprises a narrow width relative to a width of the hydraulically operated loader. The preferred squared front edge comprises a tapered edge. The preferred elongated deck comprises at least one rib. The at least one rib comprises a reinforcing rib. The preferred attachment comprises reinforcing gussets affixed to the elongated deck and a back plate. The invention further comprises reinforcements to the elongated deck sufficient to maintain a structural integrity of the deck and to maintain a balance of the hydraulically operated loader and the elongated deck loaded with materials. The preferred coupling mechanism comprises a reinforced coupling mechanism.

Also disclosed is a method of shoveling debris from a first location to a second location using a hydraulically operated loader comprising the steps of providing an elongated deck coupled to the hydraulically operated loader, maneuvering the elongated deck substantially parallel to the ground surface, driving the elongated deck into the debris at the first location and dragging the elongated deck containing a portion of the debris to the second location. The method further comprises the step of lifting and tilting the elongated deck to unload the debris.

Also disclosed is a method of leveling material on a ground surface of a work area using a hydraulically operated loader comprising the steps of providing an elongated deck coupled to the hydraulically operated loader, maneuvering the elongated deck substantially parallel to the ground surface and sweeping the elongated deck from side to side through the material.

A primary object of the present invention is to provide a unique elongated shoveling type device that can be attached to a hydraulically operated front end loader.

Another object of the present invention is the safe removal of spillage and debris from around materials handling machinery while in operation (augers, belts, vibratory screens, etc.)

A further object of the present invention is to provide a safe means of removing spillage and debris from around materials handling machinery, while keeping the operator at a location remove from moving parts.

Yet another object of the present invention is to provide a mechanical means of operation in areas previously accessible only by means of manual labor.

A further object of the present invention is to provide such a device that is operationally weight balanced so as to prevent unsafe tipping or rocking of the hydraulically operated front end loader.

A further object of the present invention is to provide a means of leveling and smoothing the area of operation.

A primary advantage of the present invention is that it removes spillage and debris safely from around materials handling machinery.

Another advantage of the present invention is that it performs its function more economically than conventional manual methods preventing shut down of materials handling machinery.

Another advantage of the present invention is that it performs its function much faster than conventional manual methods due to an increased capacity in workload.

Another advantage of the present invention is that it utilizes current safety measures already implemented on the hydraulically operated front end loader.

A further advantage of the present invention is to provide such a device that withstands the rigors associated with its intended purpose when used properly.

Another advantage of the present invention is that a higher profit margin is achieved through reduced labor cost, increased productivity, and safer management of human resources such as in lost time injuries, legal liabilities, and insurance costs.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
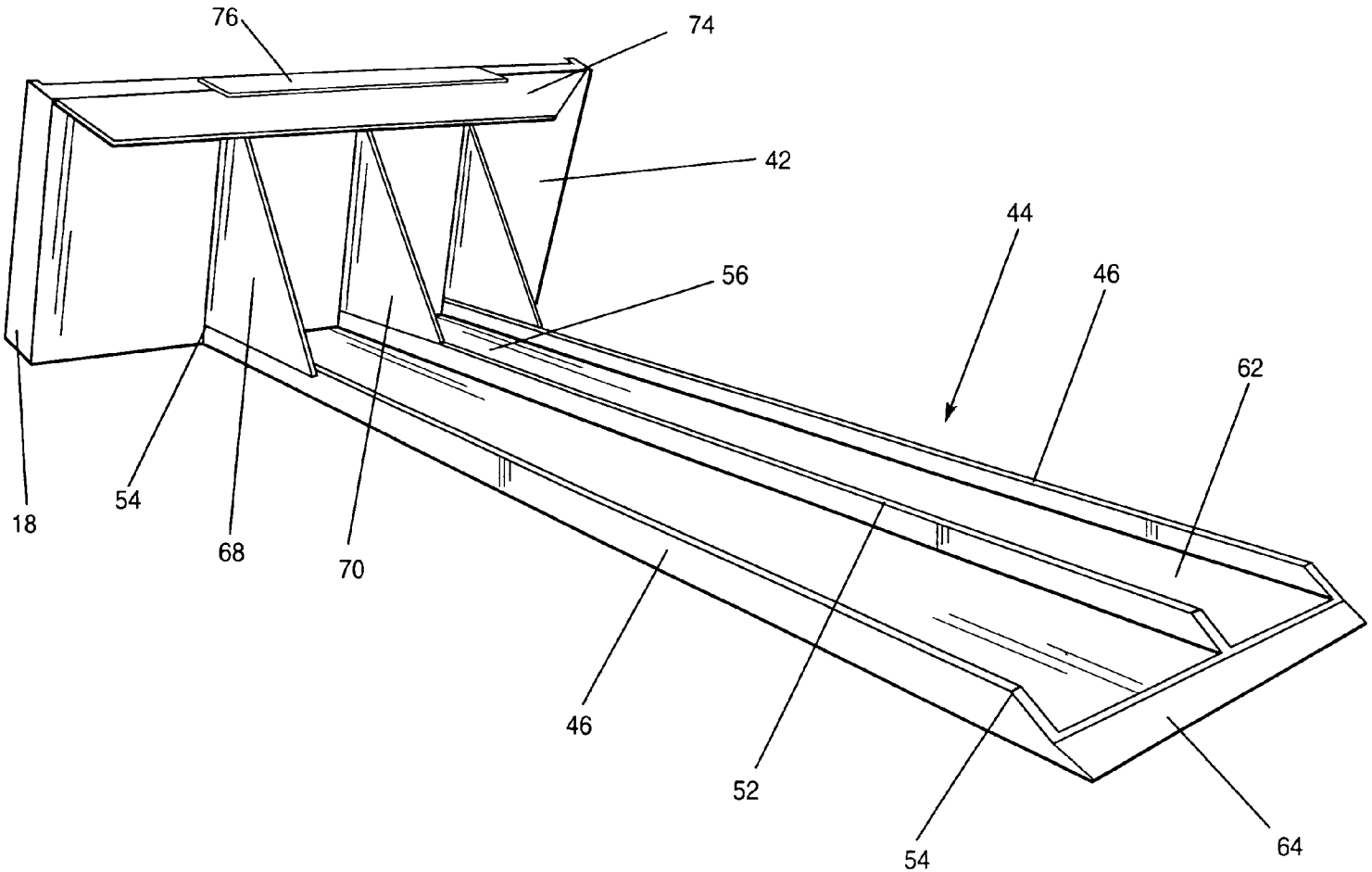
FIG. 1 is a perspective view of the preferred elongated front end loader attachment.

DESCRIPTION OF THE PREFERRED EMBODIMENTS (BEST MODES FOR CARRYING OUT THE INVENTION)

The present invention is an attachment for a loader designed to catch and remove debris from a conveyor or similar system and to remove debris from hard to reach areas. FIGS. 1 through 5 show a unique attachment 10 for any standard hydraulically operated loader 12. The attachment 10 is for removing spilled materials 14 in and around hard to reach areas where a conventional loader bucket would not reach or where moving machinery is operating and safety for laborers is in jeopardy. In order for the attachment 10 to work effectively and efficiently it must first have an appropriate means of attaching to the articulating arms of the skid steer loader or other such front loading materials handling equipment (not shown). In the case of some hydraulically operated loaders, they are equipped with a mechanical quick coupler 24 that facilitates fast and convenient removal and/or attachment of a wide variety of implements. In the preferred embodiment of the invention it would be constructed in such a manner to work in conjunction with an existing skid steer loader's mechanical quick coupler 24. This essential aspect of its construction would be accomplished through a number of key elements, which would vary depending on the proprietary nature and construction unique to a particular hydraulic loader manufacturer's mechanical quick coupler 24. In the preferred embodiment of the attachment 10, it would be fashioned so as to work in conjunction with a number of skid steer loader manufacturers, which comprise a major portion of skid steer loaders sold. The invention could also be changed to facilitate attachment to other similar materials handling equipment while remaining true to the spirit and nature of the invention.

Attachment 10 is securely and effectively attached to the hydraulic loader 12 with a tool engagement 22. The preferred tool engagement is shown on FIGS. 3*a* and 3*b*. The elements of the tool engagement 22 comprise a back plate 16 of appropriate dimensions to fit over the mechanical quick coupler 24. Back plate 16 must also be of appropriate thickness and strength to withstand the stresses placed upon it in operation. This is accomplished by the suitable thickness of material (preferably steel) used to construct the back plate 16, in combination with two 90 degree bends 18 that are made at the two, opposite, far ends of the plate 16. The back plate 16 forms a wide section of U shaped channel 20 dimensionally longer on its parallel width and shorter on its lateral length in respect to the legs of the channel. Formed this way with appropriate dimensions the back plate 16 effectively fits over the quick coupler 24 of the hydraulic loader 12 with the legs of the channel running perpendicular to the ground and pointing towards the skid steer. This portion of the back plate will now be referred to as the backside of the back plate.

The back plate 16 serves a number of purposes. First, it acts as a supporting structure for the attachment 10. The back plate 16 also provides a support structure necessary for tool engagement 22 when attached to hydraulic loader 12. Due to its unique construction and reinforced (channeled) ends 20, it provides the structural strength necessary for the unique stresses placed upon the attachment 10.

Although the means of attaching the tool engagement 22 to the hydraulic loader 12 is not unique, the construction of the back plate 16 and its various elements are uniquely suited to the uncommon stresses placed upon it due to forces placed upon it from the attachment 10. Such reinforcements are accomplished by a heavier construction of the tool engagement 22, which secures the apparatus to the hydraulic loader's quick coupler 24. For instance there is a heavy piece of steel square stock 28 which runs the lateral length of back plate 16 at the upper backside of the back plate 16. The square stock 28 is furthermore fastened on it ends to the legs of the channel 26 which is formed by the back plate 16. The square stock 28 is machined to fit the upper portion 34 of quick coupler 24. The square stock 28 also by nature of its increased thickness, its shape, and unique design, serves to strengthen the overall structural integrity of the apparatus.

Tool engagement 22 must have an effective means of being locked into position on its lower portion. This is accomplished through the construction of a first notched flat iron bar 32, the notches 31 being positioned to interface with the linkages of the quick coupler 24. The first flat iron 32 is positioned at the lower, backside of the back plate 16 running the lateral length of said plate. This first flat iron 32 is angled in such a manner as to conform to the to the corresponding angle of the quick coupler's lower portion 36. First flat iron 32 is constructed of thicker material than is commonly used on conventional material handling attachments.

This first flat iron 32 is further reinforced by the addition of a second notched flat iron 38. This second notched flat iron 38 also runs the lateral length of the of the lower backside of the back plate 16 below the first flat iron 32. The second flat iron 38 is placed at an opposing angle to the first flat iron 32 to form a triangulated reinforcement running along the lowermost edge of the lower backside of the back plate 16. The flat irons 32, 38 are joined together on the ends to the legs of the channel 20, which is formed by the back plate 16. The second flat iron 38 is notched identically to the notches in the first flat iron 32 to allow an opening 40 to prevent debris build-up, which may interfere with the union between quick coupler 24 and tool engagement 22. All of the aforementioned elements are preferably welded and or fastened to each other in such a manner as to form a congruent, boxed-in assembly.

Referring again to FIGS. 1 through 5, the front side 42 of the back plate consists of a rectangular, flat, bottomed deck 44. Deck 44 in the preferred embodiment is constructed steel or a similar material of proper thickness and strength. Deck 44 is of exaggerated length, low height, and narrow width, which remains constant in proportion from the front to the back. The rectangular, flat, bottomed deck 44 is further reinforced by one or more ribs 46 and 52 running the lateral length and perpendicular to deck 44. In the preferred embodiment there are three ribs 46 and 52, a first rib 46 placed on one outermost side and a second rib 46 on the opposite outermost side, both ribs 46 running the lateral length perpendicular to deck 44. A third rib 52 runs substantially down the center of deck 44 also running the lateral length perpendicular to deck 44 and is preferably of double strength in relation to the outside ribs 46, for additional structural support. Fewer or additional ribs can be included, depending on the type of use of the attachment and the weight of the debris 14. All the ribs 46 and 52 are cut at appropriate angles at each end of the length of deck 44. The angles 54 of the ribs at the back side 56 of the deck are cut at an angle that is equal to the back plates angle of attachment. This back side of the deck 56 is attached to the front side of the back plate 42 at the lower most edge of the back plate 60, and centered in relationship to the width of the back plate 16. At the far front portion 62 of the deck there is a half-arrow cutting edge 64 that is longer on its width than its length. It is fastened to the bottom of the front portion of the deck 44 running parallel with the width and perpendicular to the length of the deck 44.

Deck 44 is of exaggerated length, narrow width, and low height, enable the tool to be maneuvered under, between, and to depths inaccessible to conventional equipment. The length of the deck is preferably a bit longer or approximately the same as the loader's lift height to allow a debris filled deck to be emptied into a pile by lifting and tilting the deck to an unloading angle that is less than 180° from the ground. For most loaders this height is approximately ten feet. In addition, the length of the deck should not compromise the stability of the loader when the deck is filled with debris. The length should preferably be sufficient to perform its intended purposes and to maintain a proper balance when the deck is loaded with materials. Ribs 46 and 52 serve not only to strengthen the deck 44 on its lateral length but also to effectively cradle the material being handled 14, between ribs 46 and 52. The double strength rib 52 in particular serves to strengthen the deck at its point of maximum stress while further ensuring that there is no shifting of its load by creating a baffle effect. The side edges of the deck formed by the two outer ribs 46 act as a leading edge for leveling material in and around the work area. The angle cut on the ribs 54 at the front of the deck in combination with the half-arrow cutting edge 64 both allow for the easiest flow of material onto the loading surface of deck 44. This is achieved by an easier angle of penetration, accomplished by these features.

In the preferred embodiment there are three triangular gussets 68 and 70, which are attached to the front side of the back plate 42 running vertically and perpendicular to back plate 16. Gussets 68 and 70 also run perpendicular to deck 44 and form a reinforcement at the backside of deck 44, as shown. Each gusset 68 and 70 is attached to a rib 46 and 52 on the deck 44. The two outer gussets 68 are attached to the outside of the outermost ribs 46 of the deck forming a overlapping abutment. The center gusset 70 is abutted directly in line in relation to the center rib 52 of the deck intersecting at the top crown and thus extends further along the length of the deck 44. Center gusset 70 extends further along the length of the deck to create a forward offset in relation to the two outside gussets 68. This configuration helps to eliminate straight line stresses by forming a triangulated reinforcement in relation to the natural gravitational pull of the work load.

The top front side of the back plate is further reinforced by two top gussets 74 running substantially horizontal and parallel to back plate 16. Top gussets 74 are attached to the uppermost part of the front side of the back plate spanning its entire width. They are also attached to intersect, running perpendicular with the triangulated gussets 68 and 70. Each top gusset 74 is abutted against the center triangulated gusset 70 while intersecting on the top edge of the outer triangulated gusset 68. This adds structural strength to the top, front side of the back plate 16, while also preventing warping during manufacture of the attachment 10.

A step 76 can be attached to the upper most center of the front side of the back plate. Step 76 is commonly found on a skid steer loader to provide an easy and safe means of entering and exiting the operator's seat of the loader.

To use the elongated front end loader attachment 10, it must be affixed to a hydraulically operated loader 12 by means of its existing mechanical quick coupler 24. The loader 12 is maneuvered into position to join with the back plate 16 of the elongated front end loader attachment 10. It is then secured by a locking mechanism.

Figure 2:
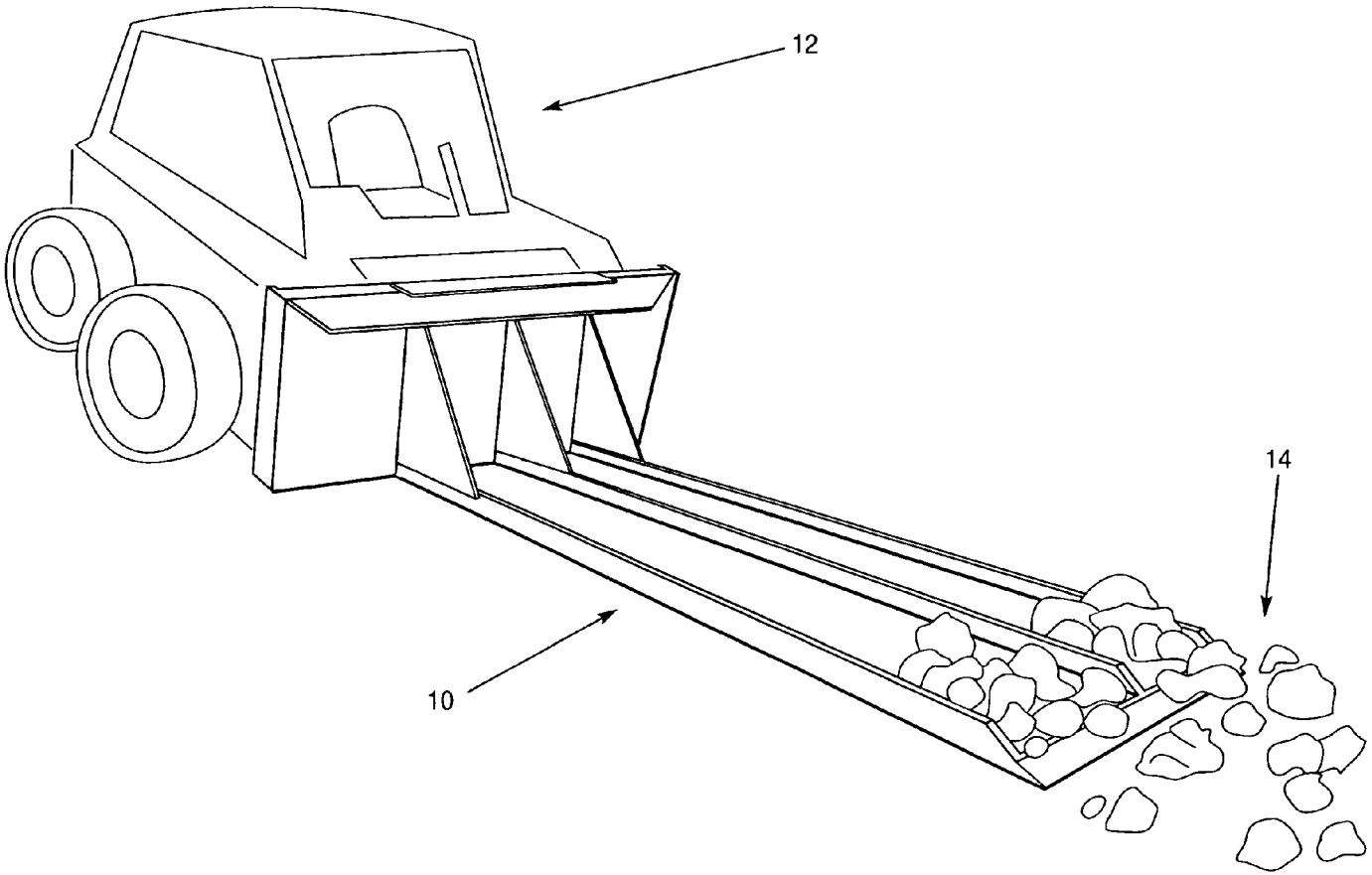
FIG. 2 is a is a perspective view of the preferred elongated front end loader attachment affixed to a front end loader.
Figure 3A:
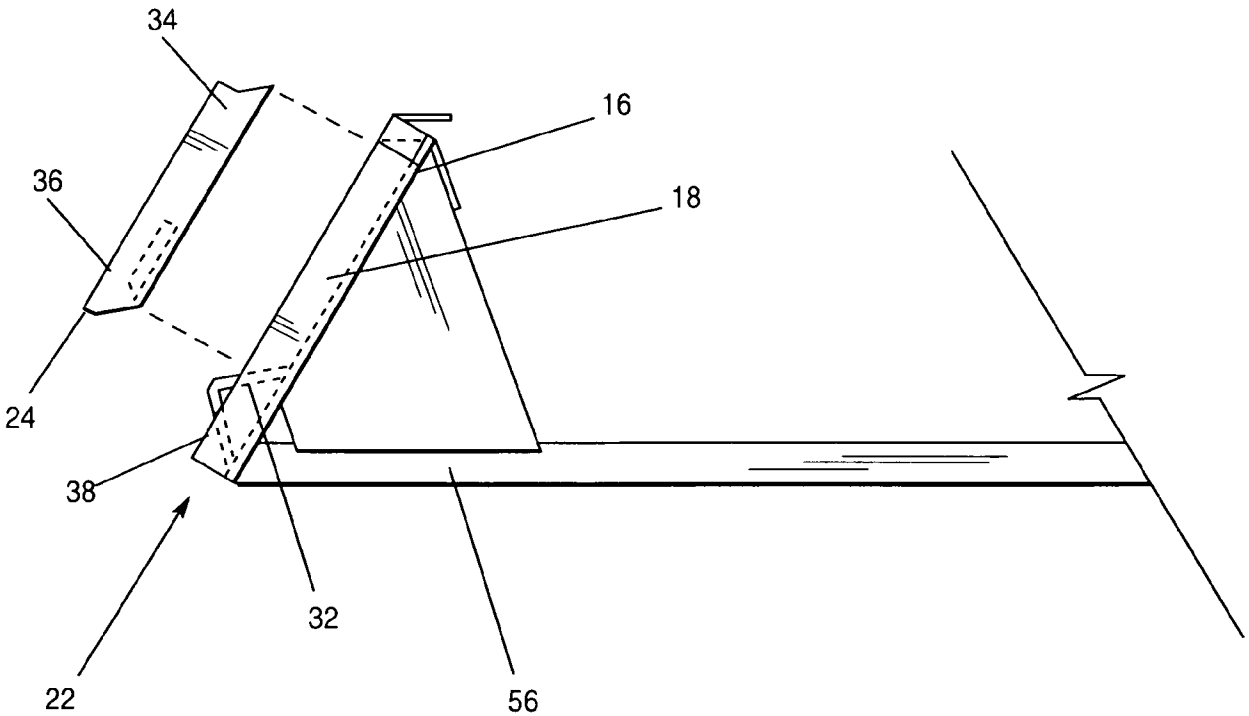
FIG. 3*a* shows a side view of the preferred tool engagement for the attachment.
Figure 3B:
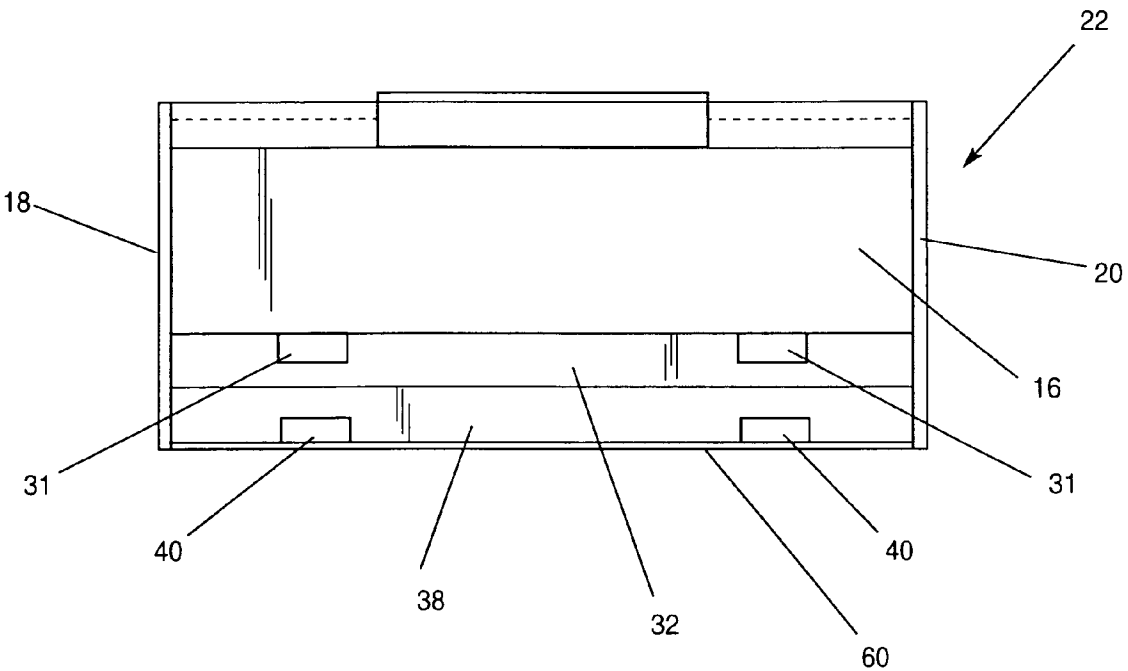
FIG. 3*b* shows a rear view of the embodiment of FIG. 2.
Figure 4:
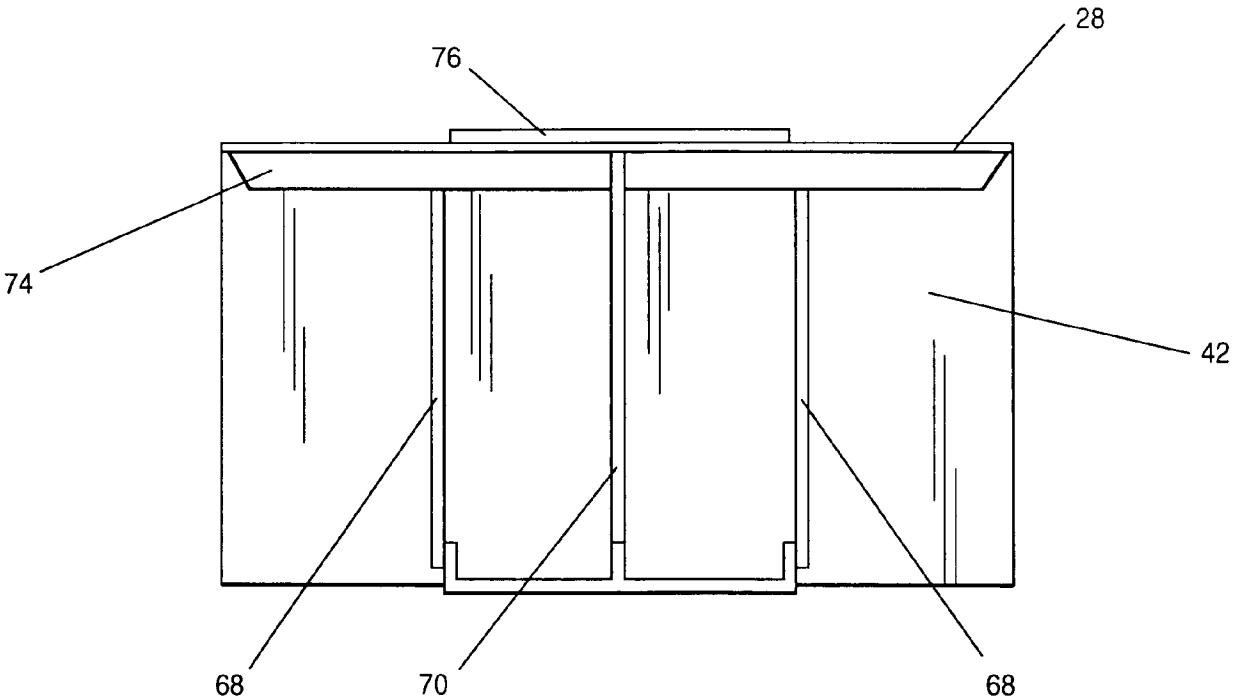
FIG. 4 shows a front view of the embodiments of FIG. 2.
Figure 5:
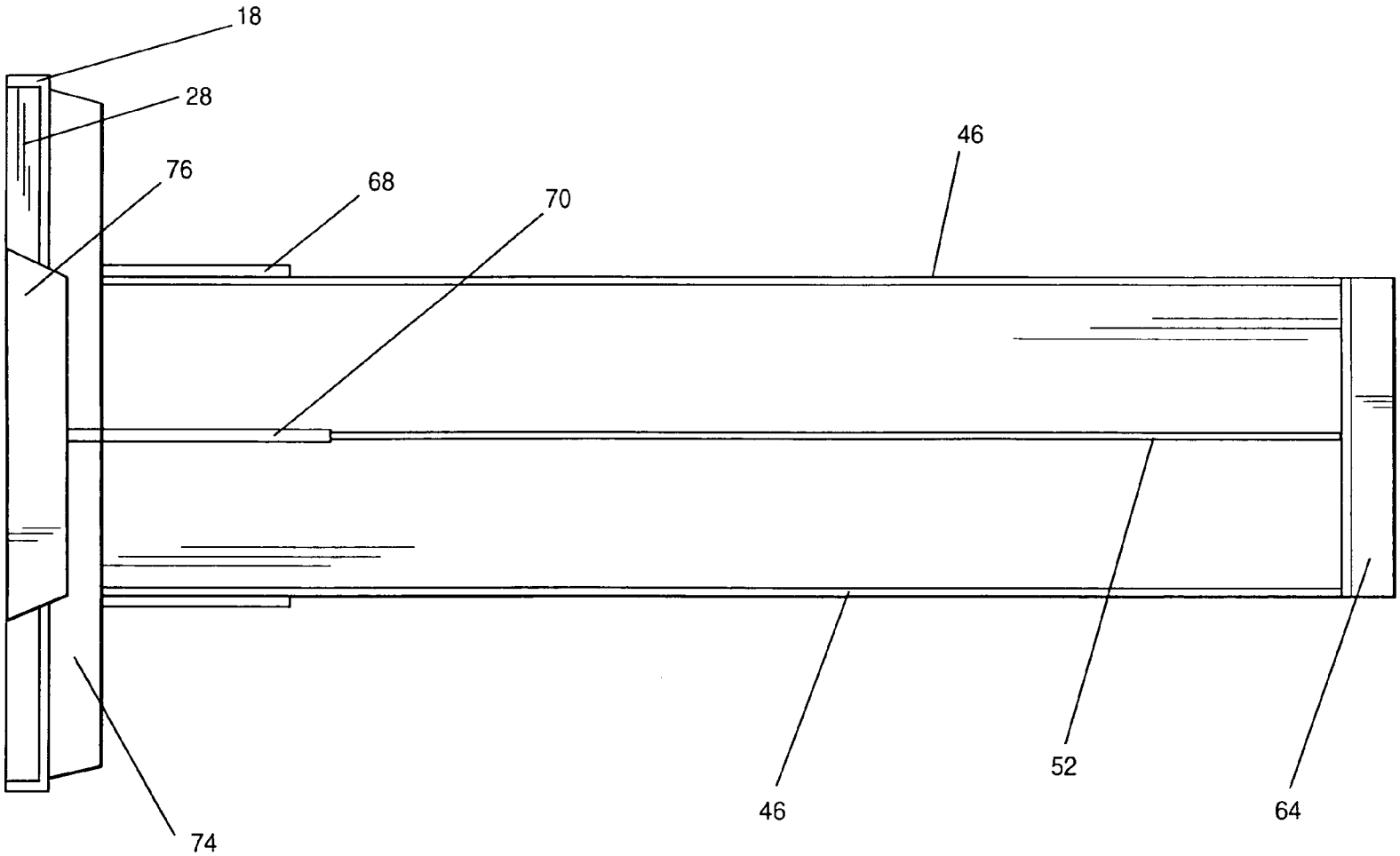
FIG. 5 shows a top view of FIG. 2.
Figure 6:
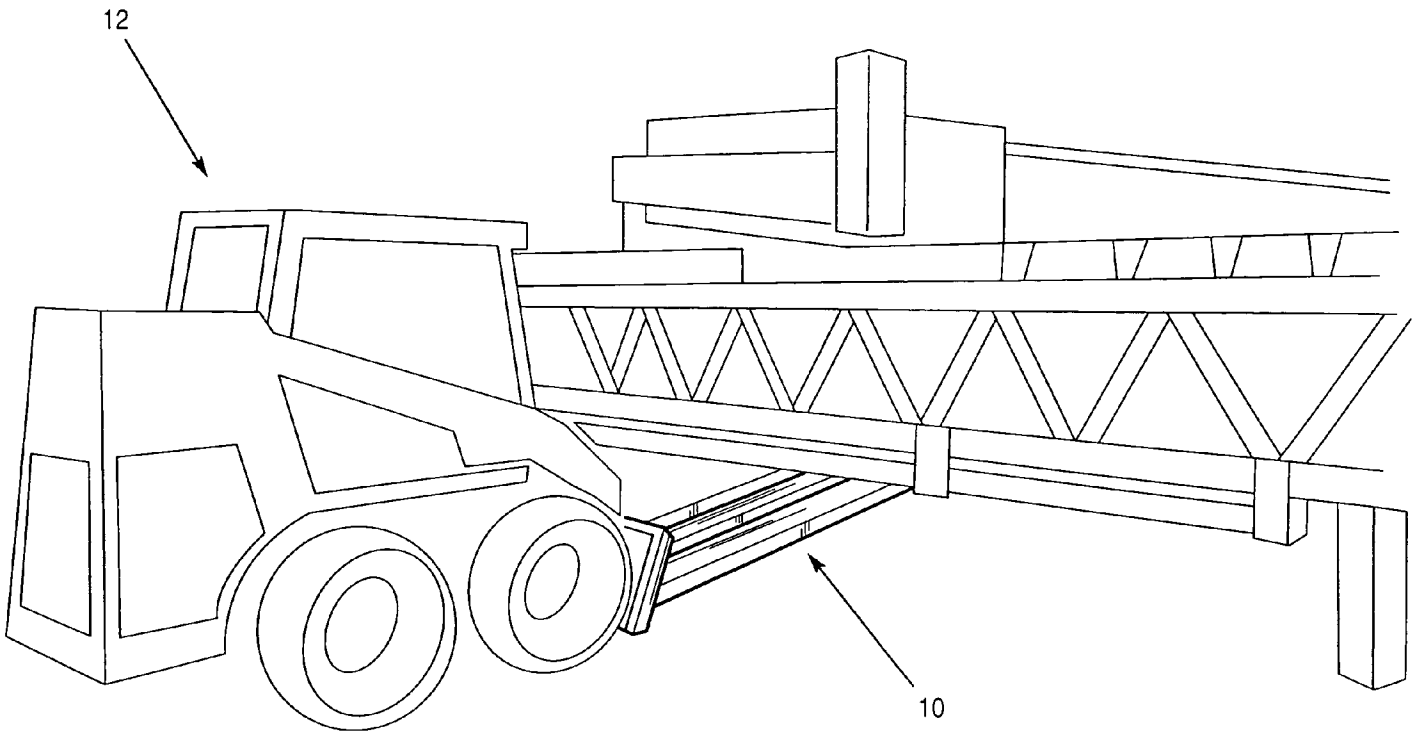
FIG. 6 shows a working view of the attachment of FIG. 2.

To operate the attachment 10, the deck 44 is placed on and parallel to the ground and is driven forward by the hydraulically operated loader 12 into the spillage 14 to a point where the material no longer flow easily on to deck 44, as shown in FIGS. 2 and 6. Any further penetration into the spillage material at this point would only serve to push material away from the machine rather than load it onto the deck 44. This method operates similar to a square head shovel and is obvious to those skilled in the art. Having "shoveled" the material 14 onto deck 44, the loader 12 is then reversed effectively pulling or dragging the material out from the confined space (under conveyors, hoppers, etc.), as shown in FIG. 6, until clear of any existing obstructions. The material is then maneuvered to a place nearby, but sufficiently away from the site of operation and dumped in a waste pile. Dumping of the material is accomplished by raising the attachment and tilting the front end of the deck downwards to an unloading angle. This is repeated as necessary until the site of operation is sufficiently rid of the spillage material. It is important to note that the proposed attachment is not intended as a loading device, or as a hauler of material to distant locations. Its intended purpose is as a cleanout device to remove spillage material from the immediate area of operation, while any loading or hauling operations would be performed by those attachments better suited to such procedures.

The attachment can also serve to smooth the area of operation by being maneuvered in a sweeping motion with the deck placed on and parallel to the ground.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

What is claimed is:

1. An attachment for a hydraulically operated loader for shoveling debris, the attachment comprising:

a coupling mechanism attached to a backplate for affixing said attachment to the hydraulically operated loader;

an elongated deck affixed substantially perpendicular to said back plate, said elongated deck comprising a substantially flat bottom surface comprising a width of a first constant dimension from a front to a back, a low predetermined height of a second constant dimension from said front to said back and a squared front edge;

at least three reinforcing ribs, each rib running a lateral length perpendicular to the elongated deck; and reinforcing gussets affixed to said ribs and the back plate.

2. The invention of claim 1 wherein said elongated deck comprises a length approximately similar to a lift height of the hydraulically operated loader.

3. The invention of claim 1 wherein said elongated deck comprises a length longer that a lift height of the hydraulically operated loader.

4. The invention of claim 1 wherein said low predetermined height comprises a height substantially less than a height of the hydraulically operated loader.

5. The invention of claim 1 wherein said width comprises a width substantially narrower than a width of the hydraulically operated loader.

6. The invention of claim 1 wherein said squared front edge comprises a tapered edge.

7. The invention of claim 1 further comprising reinforcements to said elongated deck sufficient to maintain a structural integrity of the deck and to maintain a balance of the hydraulically operated loader and the elongated deck loaded with materials.

8. The invention of claim 1 wherein said coupling mechanism comprises a reinforced coupling mechanism.

9. A method of leveling material on a ground surface of a work area using a hydraulically operated loader, the method comprising the steps of:

providing an elongated deck coupled to the hydraulically operated loader, the elongated deck affixed substantially perpendicular to a back plate, the elongated deck comprising a substantially flat bottom surface comprising a width of a first constant dimension from a front to a back, a low predetermined height of a second constant dimension from the front to the back, at least reinforcing three ribs, each rib running a lateral length perpendicular to the elongated deck and reinforcing gussets affixed to said ribs and the back plate;

maneuvering the elongated deck substantially parallel to the ground surface; and sweeping the elongated deck from side to side through the material.

* * * * *